US008302642B1

(12) United States Patent
Lindholm

(10) Patent No.: US 8,302,642 B1
(45) Date of Patent: Nov. 6, 2012

(54) INVERTABLE HANDBAG AND METHOD OF USE

(76) Inventor: Richard A. Lindholm, Daytona Beach, FL (US)

( * ) Notice: Subject to any disclaimer, the term of this patent is extended or adjusted under 35 U.S.C. 154(b) by 359 days.

(21) Appl. No.: 12/661,631

(22) Filed: Mar. 22, 2010

(51) Int. Cl.
*A45C 13/08* (2006.01)

(52) U.S. Cl. ..... 150/107; 150/100; 150/110; 150/130; 150/159; 150/105; 190/108; 190/109; 190/111; 190/18 A; 206/314; 206/315.1; 206/315.2; 206/315.3

(58) Field of Classification Search ..... 150/107, 150/100, 110, 130, 159; 190/107, 108, 109, 190/111, 112, 18 A; 206/314, 315.1, 315.2, 206/315.3; 383/29
See application file for complete search history.

(56) References Cited

U.S. PATENT DOCUMENTS

| | | | | | |
|---|---|---|---|---|---|
| 2,126,898 | A | | 10/1937 | Landis | |
| 2,413,465 | A | | 4/1942 | Ohlsen | |
| D299,587 | S | * | 1/1989 | Thomas | D3/283 |
| D308,602 | S | * | 6/1990 | St. Pierre | D3/269 |
| 5,054,589 | A | * | 10/1991 | Bomes et al. | 190/18 A |
| D357,351 | S | * | 4/1995 | Kelsall | D3/261 |
| 5,955,948 | A | * | 9/1999 | Howell | 340/568.7 |
| 6,807,992 | B2 | * | 10/2004 | Powers | 150/105 |
| 6,910,560 | B2 | * | 6/2005 | Dulin | 190/109 |
| D506,865 | S | * | 7/2005 | Homsher et al. | D3/254 |
| 7,316,313 | B1 | * | 1/2008 | Juchau | 206/315.1 |
| D604,950 | S | * | 12/2009 | Greiner | D3/246 |
| 2002/0153074 | A1 | | 10/2002 | Chen et al. | |
| 2005/0173034 | A1 | | 8/2005 | Antrobus | |

* cited by examiner

*Primary Examiner* — Anthony Stashick
*Assistant Examiner* — Cynthia Collado
(74) *Attorney, Agent, or Firm* — Paul S. Rooy PA

(57) ABSTRACT

An invertible handbag. The invertible handbag has a handbag compartment defined by four sides, a handbag roof, and a handbag floor; a handbag roof mouth bordered by a handbag roof mouth closure in the handbag root and a handbag floor mouth bordered by a handbag floor mouth closure in the handbag floor. A strap is swivelably attached to strap bridges at opposite ends of the invertible handbag. Method steps are taught wherein the handbag closures may be closed, the invertible handbag inverted, and then the uppermost closure and mouth opened, to permit seeing and removing items which were formerly lost at the bottom of the handbag compartment. Means is disclosed to hold the closures closed. Optional sidebags may be mounted to the handbag sides, each including a sidebag roof mouth closure and a sidebag floor mouth closure.

24 Claims, 6 Drawing Sheets

INVERTABLE HANDBAG AND METHOD OF USE

BACKGROUND OF THE INVENTION

1. Field of the Invention

This invention relates handbags and purses, and in particular to an invertible handbag and method of use.

2. Background of the Invention

Handbags and purses have long been used to carry incidentals such as make-up, documents, chewing gum and snacks, handkerchiefs, tissues, eye glasses, money, small flashlights, car keys, house keys, cell phones, pepper spray, etc. Back in biblical days, it was noted that traitors were paid with purses full of silver coins.

One on-going problem associated with use of purses and handbags being used to carry a miscellanea of small items is the dreaded "disappearing item" syndrome. This occurs when a small item such as a set of house keys descends to the bottom of a purse full of other things, and becomes difficult to find. It may be necessary to up-end the purse, dump out the entire contents, and search through the contents in order to finally find the elusive keys.

The procedure of having to dump out the contents of purse or handbag onto a flat surface in order to find a small item which has migrated to the bottom of the bag presents a number of problems. Contents of the purse may be damaged during the "dumping out" operation, especially if they are delicate, such as eye glasses. Another problem is finding an appropriate flat surface upon which to dump the contents of the purse or handbag—the kitchen table is not always readily available for this purpose.

Another problem lies in that not only must the contents be dumped out and searched through, but the contents must then be re-inserted into the purse or handbag—overall, a labor-intensive exercise. In addition, the very action of dumping out the handbag may have the effect of re-positioning smaller items to the bottom of the pile once more, thus exacerbating the efforts to locate them.

Accordingly, it would be desirable to provide a handbag or purse whose lower-most items can be searched without digging around in the purse or dumping its contents out. This could be achieved by providing a handbag with a first closure along a first mouth on its top, and a second closure along a second mouth on its bottom, both mouths permitting access to a handbag central compartment. This apparatus would permit a method of use including the steps of closing the first closure, up-ending the handbag, and opening the second closure in order to access items which were formerly bottom-most, but are now top-most by virtue of having up-ended the handbag.

Existing Designs

A number of approaches have been suggested to provide a handbag with opposite openings. Landis was granted U.S. Pat. No. 2,126,898 for a handbag which provided upper and lower closures, both zippers in this case. The upper zipper provided access to an apparently conventional handbag compartment, while the lower zipper provide access to a pair of secret compartments separated from the conventional handbag compartment by walls. While the Landis '898 handbag provided opposite closures, these did not access a common receptacle, thus rending the Landis '898 handbag unsuitable for the instant purpose of accessing the bottom of a handbag's central compartment by inverting the handbag.

U.S. Pat. No. 6,910,560 was granted Dulin for a suitcase having opposite, openable sides. While this invention taught opposite opening sides, both giving onto a single central compartment, there were several problems associated with this design. On problem was the lack of means to hold the zippers closed, which is desirable to prevent inadvertent zipper opening and unwanted spillage of the contents. Another problem lies in the absence of a reversible shoulder strap or other holding means attached with swivels which would tend to hold the handbag in a given orientation, be it right-side-up or inverted.

SUMMARY OF THE INVENTION

Accordingly, it is an object of the present invention to provide an invertible handbag which may be inverted without spilling its contents. Design features allowing this object to be accomplished include a handbag compartment having a handbag roof mouth with handbag roof mouth closure, and a handbag floor mouth with handbag floor mouth closure. Advantages associated with the accomplishment of this object include the ability to close both closures, invert the handbag, and open the top closure, thus permitting items within the handbag compartment to be viewed in an uppermost position within the handbag compartment, which items were formerly in a lowermost position within the handbag compartment, thus facilitating finding such items.

It is another object of the present invention to provide an invertible handbag and method of use which incorporates a strap which automatically adjusts its attach points on the invertible handbag. Design features allowing this object to be accomplished include slidable attachment between strap ends and a vertically-oriented strap bridge. Benefits associated with the accomplishment of this object include increased stability of the invertible handbag, and reduced capsizing tendency.

It is still another object of this invention to provide an invertible handbag and method of use which provides means to hold its closures in the closed position. Design features enabling the accomplishment of this object include a closure slider with pull tab, and pull tab closure means on the pull tab and invertible handbag. An advantage associated with the realization of this object is reduction of the chance of unwanted closure opening, and consequent avoidance of unwanted spillage of contents of the invertible handbag.

It is another object of the present invention to provide an invertible handbag and method of use which facilitates finding items in a handbag compartment which have descended to the bottom of the handbag compartment. Method steps allowing this object to be accomplished include closing the upper closure, inverting the invertible handbag, opening the formerly lower closure and mouth, and seeing and removing the item which was lost at the bottom of the handbag compartment. Benefits associated with the accomplishment of this object include time and effort savings in finding items lost at the bottom of a handbag compartment under other obscuring items.

BRIEF DESCRIPTION OF THE DRAWINGS

The invention, together with the other objects, features, aspects and advantages thereof will be more clearly understood from the following in conjunction with the accompanying drawings.

Six sheets of drawings are provided. Sheet one contains FIG. 1. Sheet two contains FIG. 2. Sheet three contains FIGS. 3 and 4. Sheet four contains FIGS. 5 and 6. Sheet five contains FIG. 7. Sheet six contains FIGS. 8 and 9.

DETAILED DESCRIPTION OF THE PREFERRED EMBODIMENT

Figure 1:
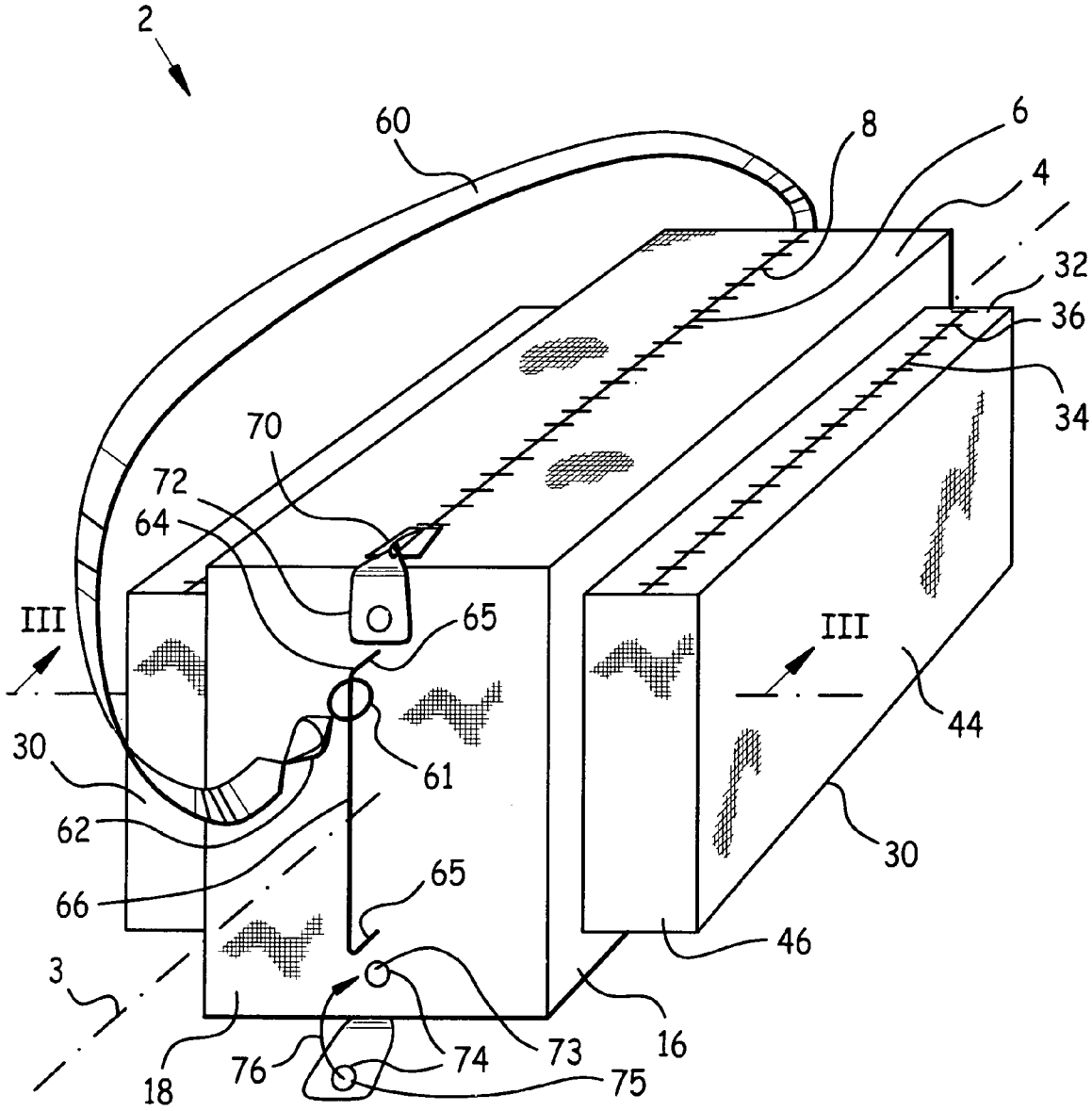
FIG. 1 is a front quarter elevated isometric view of an invertible handbag.
Figure 2:
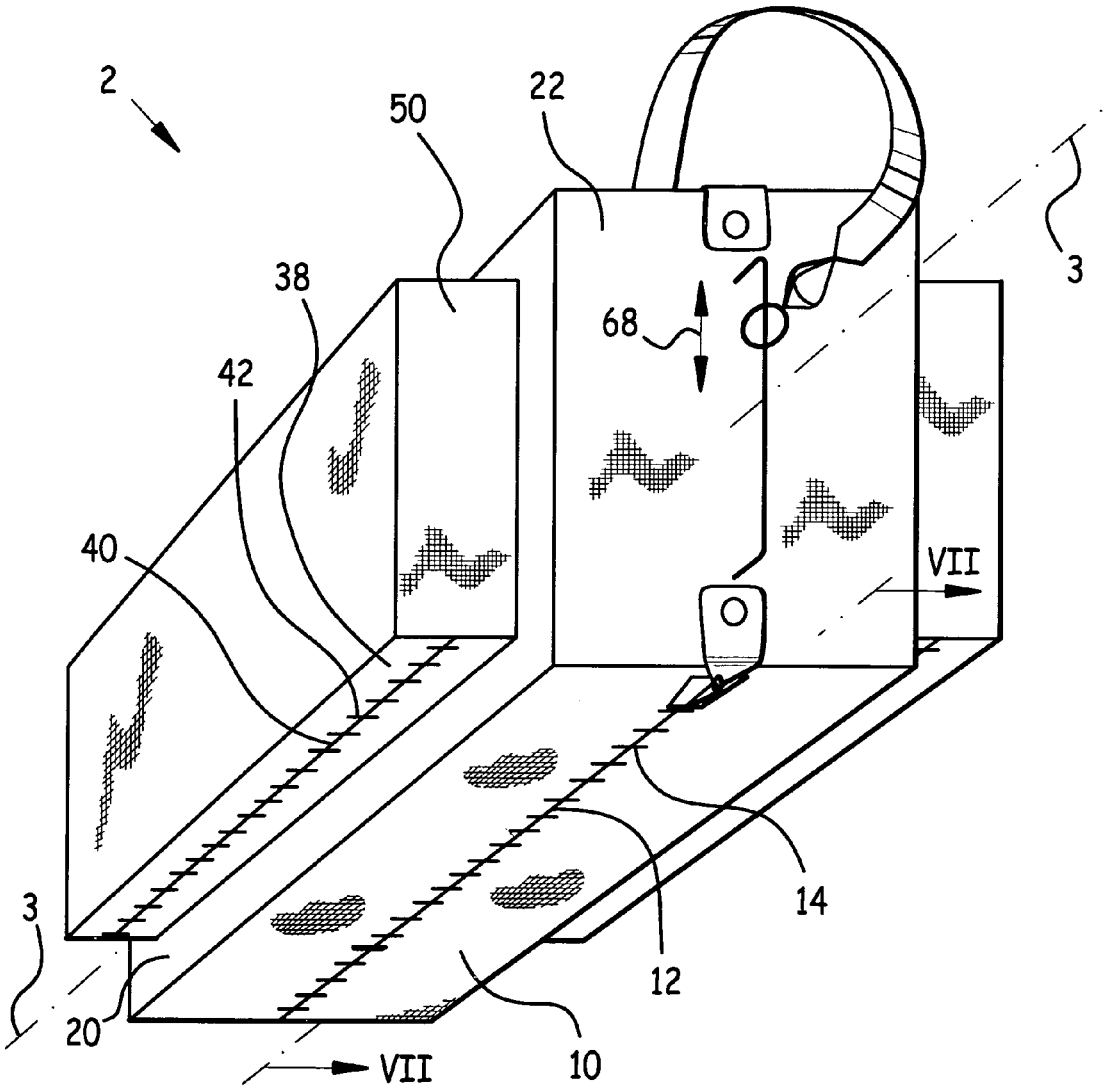
FIG. 2 is a rear quarter lower isometric view of an invertible handbag.
Figure 3:
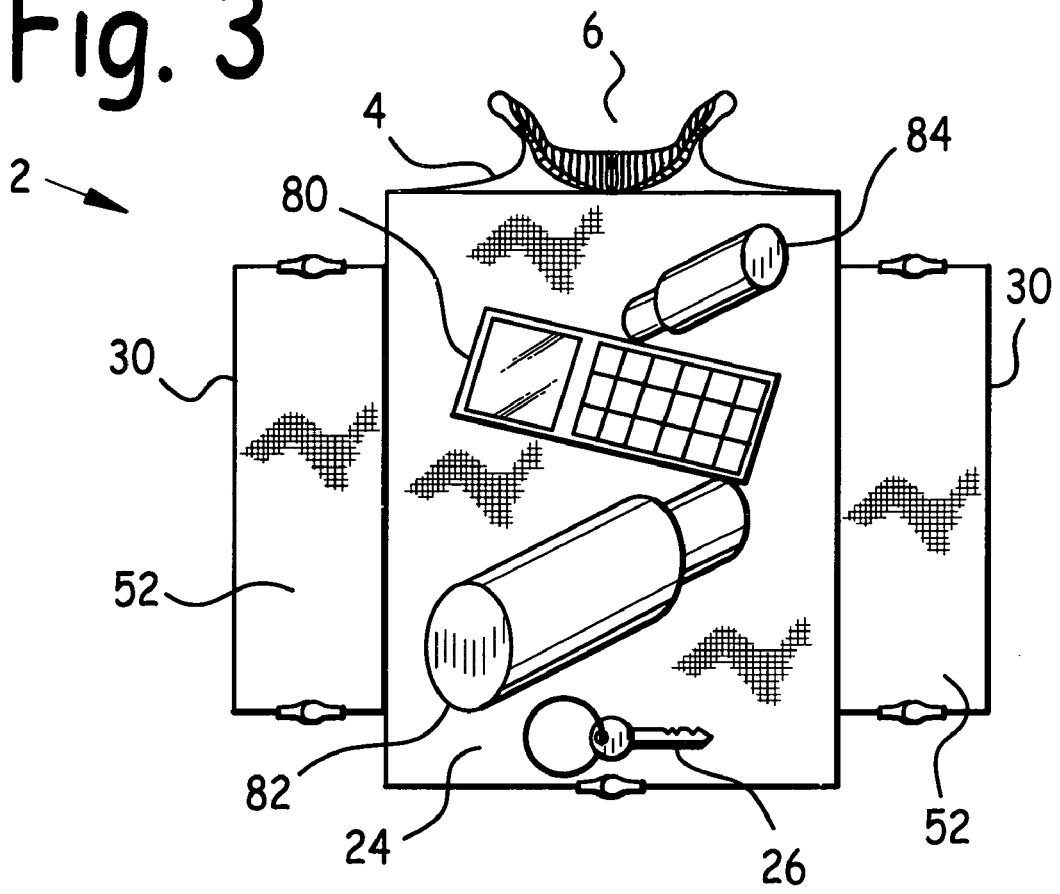
FIGS. 3-6 are cross-sectional views of an invertible handbag taken at section of FIG. 1, depicting the instant method of using an invertible handbag.

Referring now to FIG. 1, a front quarter elevated isometric view of invertible handbag 2, FIG. 2, a rear quarter lower isometric view of an invertible handbag, and FIG. 3, a cross-sectional view of invertible handbag 2 taken at section III-III of FIG. 1, we can observe that invertible handbag 2 comprises handbag compartment 24 defined by handbag roof 4, handbag first side 16, handbag second side 18, handbag third side 20, handbag fourth side 22, and handbag floor 10.

Handbag roof mouth 6 is disposed in handbag roof 4. Handbag roof mouth closure 8 is disposed along handbag roof mouth 6, and serves to close or open handbag roof mouth 6, through which access may be had to handbag compartment 24. Handbag compartment 24 communicates with the exterior through handbag roof mouth 6 when handbag roof mouth closure 8 is open. Handbag floor mouth 12 is disposed in handbag floor 10. Handbag floor mouth closure 14 is disposed along handbag floor mouth 12, and serves to close or open handbag floor mouth 12, through which access may be had to handbag compartment 24. Handbag compartment 24 communicates with the exterior through handbag floor mouth 12 when handbag floor mouth closure 14 is open.

In the preferred embodiment, handbag roof mouth 6 extends from handbag second side 18 to handbag fourth side 22 and is substantially centered on handbag roof 4, and handbag floor mouth 12 extends from handbag second side 18 to handbag fourth side 22 and is substantially centered on handbag floor 10.

Handbag roof mouth closure 8 and handbag floor mouth closure 14 comprise means of maintaining them in the closed position depicted in FIGS. 1 and 2. In the preferred embodiment, handbag roof mouth closure 8 and handbag floor mouth closure 14 were zippers having slider 70 with pull tab 72 attached. Pull tab 72 comprised pull tab closure 74. In the preferred embodiment pull tab closure 74 comprised a permanent magnet attached to pull tab 74, and a mating piece of ferromagnetic material or an opposite-poled magnet attached to a corresponding handbag side, handbag second side 18 in FIG. 1. In operation, the zipper is closed completely, and then pull tab 72 is folded flat against the adjacent handbag side until its magnet latches onto the piece of ferromagnetic material or opposite-poled magnet attached to the adjacent handbag side, as indicated by arrow 76 in FIG. 1.

Although the figures depict pull tab closure 74 as a round permanent magnet 73 attached to pull tab 74 and a round piece of ferromagnetic material 75 or opposite-poled magnet attached to the adjacent handbag side, it is intended to fall within the scope of this disclosure that any appropriate pull tab closure 74 be used, including but not limited to a snap, button and buttonhole, hook and loop material, etc.

Invertible handbag 2 further comprises strap 60. One end of strap 60 is slidably attached to handbag second side 18 by means of strap bridge 64; the opposite end of strap 60 is attached to handbag fourth side 22 by means of strap bridge 64. Each strap bridge 64 comprises a strap bridge leg 65 attached at either end of strap bridge span 66 at substantially right angles to strap bridge span 66. Strap bridge legs 65 and strap bridge span 66 are substantially co-planar.

Strap bridge legs 65 are attached at substantially right angles to handbag second side 18 and to handbag fourth side 22, and serve to set off each strap bridge span 66 from the respective handbag side to which its corresponding strap bridge legs 65 are mounted, so as to permit strap ring 61 to slide freely along the length of strap bridge span 66 as indicated by arrow 68 in FIG. 2.

Each end of strap 60 is slidably attached to a respective strap bridge 64 by means of strap swivel 62 and strap ring 61. Strap ring 61 is sized to slidably admit strap bridge span 66, so that it may reciprocate freely along strap bridge span 66. Strap swivel 62 permits each end of strap 60 to rotate freely relative the respective side of invertible handbag 2 to which it is mounted, so that strap 60 does not become twisted when invertible handbag 2 is inverted, and to permit invertible handbag 2 to freely be inverted when supported by strap 60.

Each strap bridge 64 is disposed substantially at the center of the respective invertible handbag side to which it is attached, and substantially vertically when invertible handbag 2 rests on handbag floor 10 or handbag roof 4.

That is to say, one strap bridge 64 is disposed substantially along a line extending from the intersection of handbag roof mouth closure 8 and handbag second side 18, and the intersection of handbag floor mouth closure 14 and handbag second side 18, where handbag roof mouth closure 8 extends from handbag second side 18 to handbag fourth side 22 and is substantially centered on handbag roof 4, and where handbag floor mouth closure 14 extends from handbag second side 18 to handbag fourth side 22 and is substantially centered on handbag floor 10.

Similarly, the other strap bridge 64 is disposed substantially along a line extending from the intersection of handbag roof mouth closure 8 and handbag fourth side 22, and the intersection of handbag floor mouth closure 14 and handbag fourth side 22, where handbag roof mouth closure 8 extends from handbag second side 18 to handbag fourth side 22 and is substantially centered on handbag roof 4, and where handbag floor mouth closure 14 extends from handbag second side 18 to handbag fourth side 22 and is substantially centered on handbag floor 10.

When invertible bag 2 is suspended from strap 60, as when being carried by its user, strap rings 61 will slide upwards to uppermost ends of strap bridges 64. This places the support points of invertible handbag 2 stably above its center of gravity, and there will be no capsizing tendency. When invertible bag 2 is inverted and then once again suspended from strap 60, as when being carried by its user, strap rings 61 will once again slide upwards to uppermost ends of strap bridges 64, once again placing the support points of invertible handbag 2 stably above its center of gravity, thus eliminating any capsizing tendency. Strap swivels 62 prevent strap 60 from becoming twisted when inverting invertible handbag 2.

Invertible handbag 2 may incorporate one or more invertible sidebags 30. The embodiment depicted in FIGS. 1 and 2 show one invertible sidebag 30 mounted to handbag first side 16, and another invertible sidebag 30 mounted to handbag third side 20.

Each invertible sidebag comprises sidebag compartment 52 defined by sidebag roof 32, sidebag first side 44, sidebag second side 46, sidebag third side 48, and sidebag fourth side 50, and sidebag floor 38.

Sidebag roof mouth 34 is disposed in sidebag roof 32. Sidebag roof mouth closure 36 is disposed along sidebag roof mouth 34, and serves to close or open sidebag roof mouth 34, through which access may be had to sidebag compartment 52. Sidebag compartment 52 communicates with the exterior through sidebag roof mouth 34 when sidebag roof mouth closure 36 is open.

Sidebag floor mouth 40 is disposed in sidebag floor 38. Sidebag floor mouth closure 42 is disposed along sidebag floor mouth 40, and serves to close or open sidebag floor mouth 40, through which access may be had to sidebag compartment 52. Sidebag compartment 52 communicates with the exterior through sidebag floor mouth 40 when sidebag floor mouth closure 42 is open.

In the preferred embodiment, sidebag roof mouth 34 extends from sidebag second side 46 to sidebag fourth side 50 and is substantially centered on sidebag roof 32, and sidebag floor mouth 40 extends from sidebag second side 46 to sidebag fourth side 50 and is substantially centered on sidebag floor 38.

In the preferred embodiment, each invertible sidebag 30 is attached to invertible handbag 2 at sidebag first side 44 or sidebag third side 48.

Sidebag roof mouth closure 36 and sidebag floor mouth closure 42 comprise means of maintaining them in the closed position depicted in FIGS. 1 and 2. In the preferred embodiment, sidebag roof mouth closure 36 and sidebag floor mouth closure 42 were zippers having slider 70 with pull tab 72 attached. Pull tab 72 comprised pull tab closure 74. In the preferred embodiment pull tab closure 74 comprised a permanent magnet attached to pull tab 74, and a mating piece of ferromagnetic material (or opposite-poled magnet) attached to a corresponding handbag side, sidebag second side 46 in FIG. 1. In operation, the zipper is closed completely, and then pull tab 72 is folded flat against the adjacent sidebag side until its magnet latches onto the piece of ferromagnetic material ore opposite-pole magnet attached to the adjacent handbag side.

Although the figures depict pull tab closure 74 as a round permanent magnet attached to pull tab 74 and a round piece of ferromagnetic material (or opposite-poled magnet) attached to the adjacent handbag side, it is intended to fall within the scope of this disclosure that any appropriate closure 74 be used, including but not limited to a snap, button and buttonhole, hook and loop material, etc.

FIGS. 3-6 are cross-sectional views of an invertible handbag taken at section of FIG. 1, depicting the instant method of using an invertible handbag.

FIG. 3 depicts invertible handbag 2 in the upright position depicted in FIGS. 1 and 2. Its handbag compartment 24 contains a number of items, including lipstick 84, cell phone 80, skin cream 82, and key 26. The user of invertible handbag 2 wishes to find key 26. Unfortunately, key 26 has migrated to the bottom of handbag compartment 24, and is difficult to find due to the other items within handbag compartment 24 on top of key 26. The conventional method to attempt to find key 26 would be for the user of the handbag to introduce a hand through open handbag roof mouth 6 and grope around blindly for key 26, or as a last resort, to upend the handbag and empty its contents on a flat surface, as explained previously. These are difficult and potentially time-consuming and frustrating processes.

Figure 4:
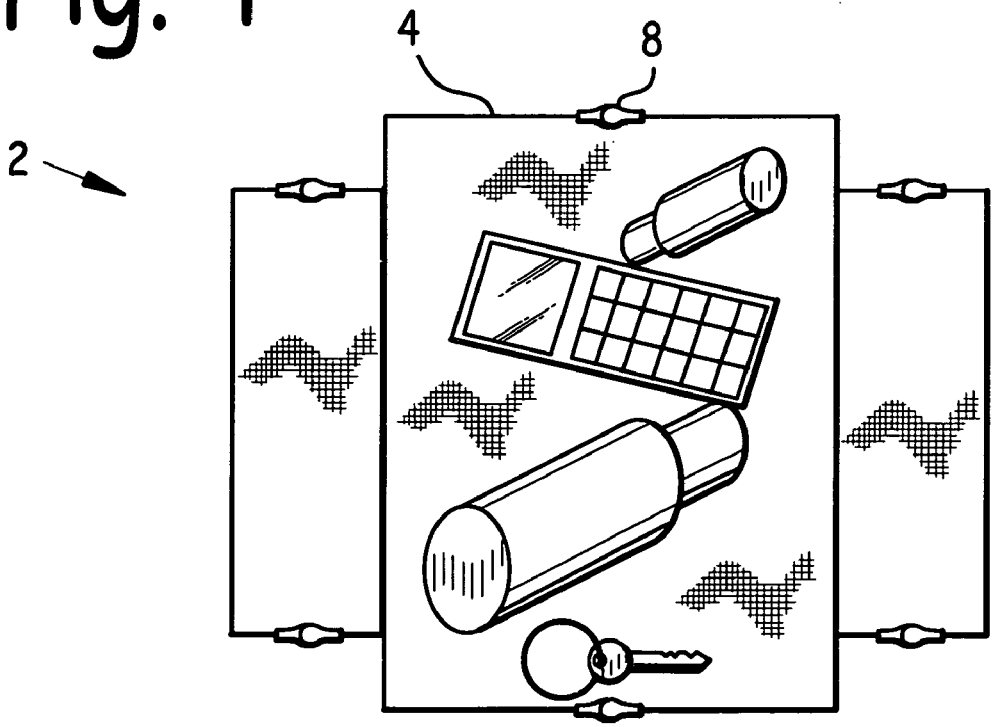
Figure 5:
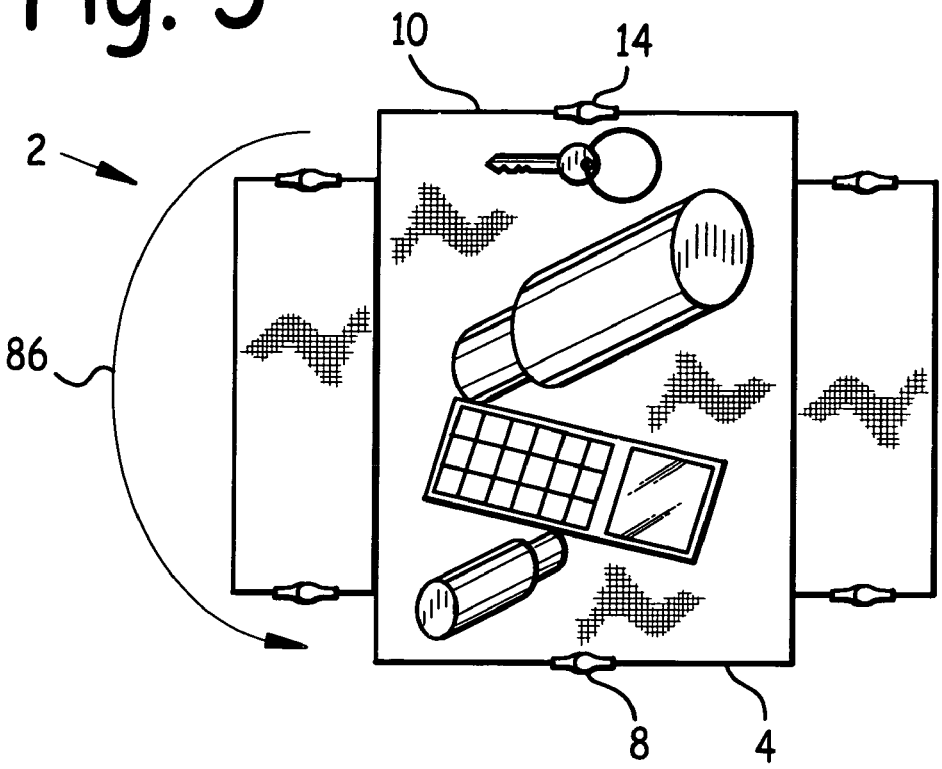
Figure 6:
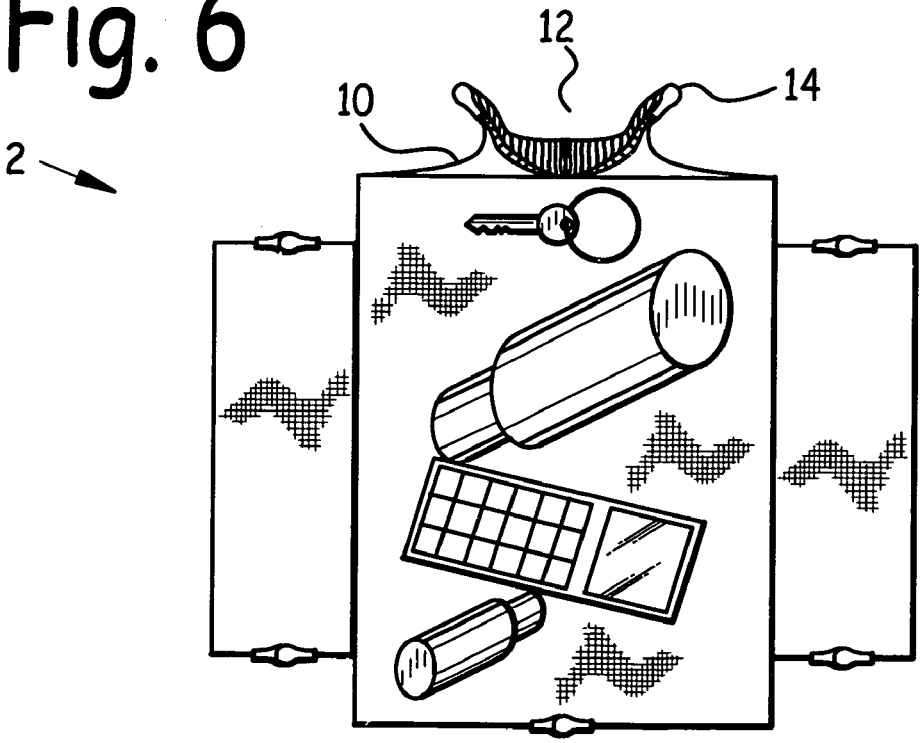

Luckily for the user of invertible handbag 2, the instant method avoids this difficulty. As depicted in FIG. 4, first handbag roof mouth closure 8 is closed (note that both handbag roof mouth 6 and handbag floor mouth 12 are now in the closed position), and then invertible handbag 2 is inverted as indicated by arrow 86 in FIG. 5. Invertible handbag 2 is now in the inverted position, with handbag roof 4 lower-most, and handbag floor 10 upper-most. FIGS. 5 and 6 depict invertible handbag 2 in the inverted position.

Not only is invertible handbag 2 in the inverted position, but so also are its contents: what was previously bottom-most within handbag compartment 24 is now upper-most, and visa-versa. Specifically, the elusive, formerly bottom-most key 26 is now upper-most, and easily visible when handbag floor mouth closure 14 is opened, and handbag floor mouth 12 is in the open position depicted in FIG. 6. It is now an easy exercise to simple look through handbag floor mouth 12 to see key 26, grab it, and remove it from handbag compartment 24 through handbag floor mouth 12.

Invertible handbag 2 may now be used and worn in the inverted position depicted in FIGS. 5 and 6 until such time as something sought to be found has migrated to the bottom of handbag compartment 24, at which time the process described in the three paragraphs above can be repeated, this time closing handbag floor mouth closure 14 prior to turning invertible handbag 2 back upright into the position depicted in FIGS. 1 and 2, and opening handbag roof mouth closure 6 thereafter.

Note that invertible handbag 2 has no "upright" or "inverted" position per se, because invertible handbag 2 is bilaterally symmetrical about a plane parallel to, and disposed midway between, handbag roof 4 and handbag floor 10. Thus, in a nutshell, the instant method comprises the steps of ensuring that both handbag roof mouth closure 8 and handbag floor mouth closure 14 are closed, inverting handbag 2, and opening the uppermost handbag mouth closure to see and remove an elusive object which was formerly bottom-most within handbag compartment 24, but is now upper-most and easily visible by virtue of having inverted invertible handbag 2.

The operation of inverting invertible handbag 2 may be also described as rotating invertible handbag 2 substantially 180 degrees about handbag longitudinal axis 3, where handbag longitudinal axis 3 is defined as a line parallel to and midway between handbag roof 4 and handbag floor 10, and passing through the geometrical centers of handbag second side 18 and handbag fourth side 22.

Accordingly, the instant method comprises the steps of:

A. Providing an invertible handbag comprising a handbag compartment defined by handbag roof, handbag floor, and handbag sides; a handbag roof mouth with handbag roof mouth closure; a handbag floor mouth with handbag floor mouth closure; and contents within the handbag compartment, including a lost lower-most item;

B. Ensuring that both closures are closed;

C. Inverting the invertible handbag by rotating it 180 degrees about the handbag longitudinal axis;

D. Opening the uppermost closure;

E. Opening the uppermost mouth; and

F. Seeing and removing the lost item.

It may be readily appreciated that the instant method may also be used with invertible sidebags 30, by ensuring that both sidebag roof mouth closure and sidebag floor mouth closure are closed, inverting sidebag 30, opening the upper-most sidebag mouth closure and sidebag mouth, and seeing and removing an item which was formerly bottom-most within invertible sidebag 30.

The instant method may include the additional steps of providing a strap bridge at each handbag end, and a strap slidably attached at one end to one of the strap bridges and at its other end to the other strap bridge, allowing the strap ends to slide to the top of each strap bridge when the invertible bag is suspended from the strap, inverting the invertible bag, and allowing the strap ends to slide to the top of each strap bridge when the invertible bag is suspended from the strap.

The instant method may include the additional steps of attaching the strap ends to the invertible bag using strap swivels, and allowing the invertible bag to swivel relative to the strap when the invertible bag is being inverted, thus avoiding twisting the strap or forcing it to turn over when inverting the invertible bag.

Figure 7:
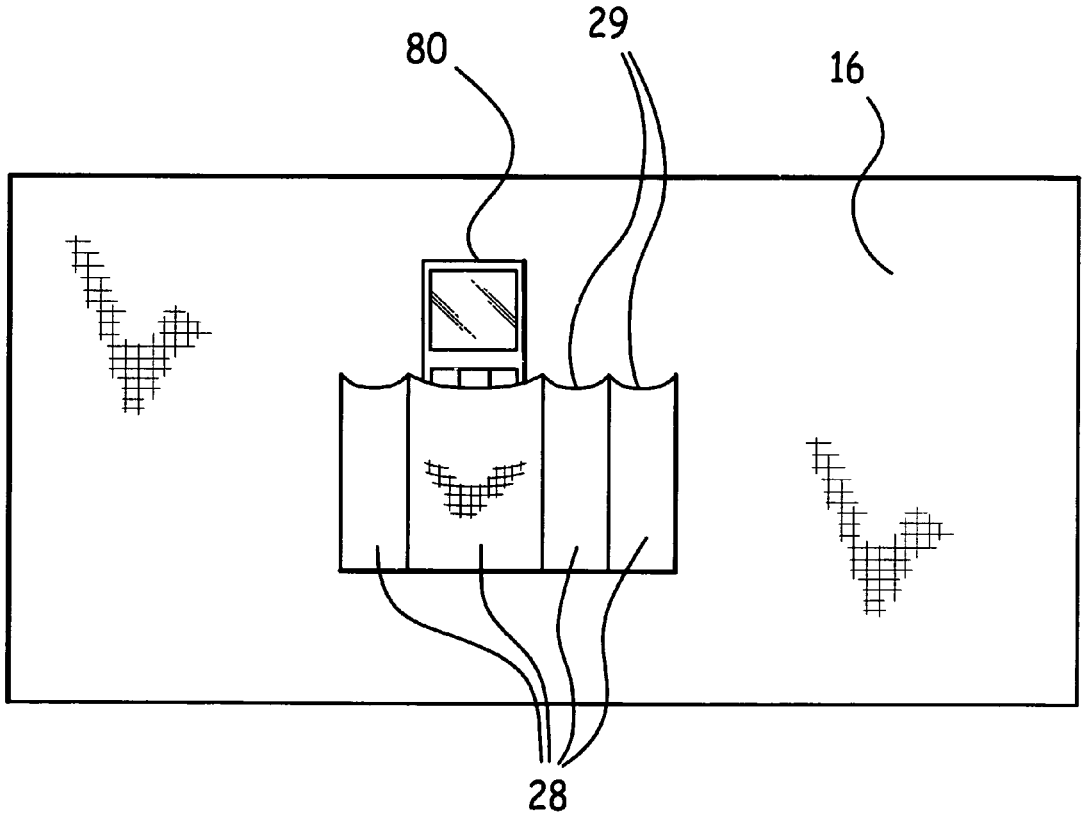
FIG. 7 is a side cross-sectional view of an invertible handbag taken at section VII-VII of FIG. 2, depicting interior pockets.

FIG. 7 is a side cross-sectional view of an invertible handbag taken at section VII-VII of FIG. 2, depicting interior pockets 28. One or more interior pocket 28 may be disposed inside handbag compartment 24 on any handbag side 16, 18, 20 or 22, to help organized the contents of invertible handbag 2. Interior pockets 28 may be of different sizes to accommodate different items such as cell phone 80, lipstick 84, etc. In addition, interior pockets 28 may incorporate elastic 29 to help grip items inserted into them.

Figure 8:
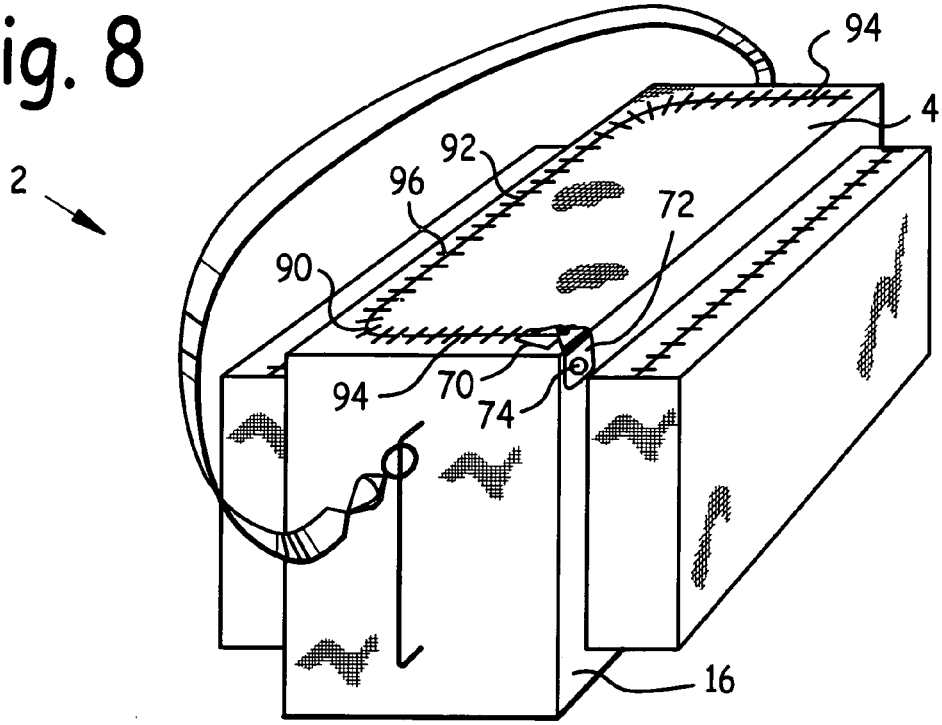
FIGS. 8 and 9 are front quarter elevated isometric views of an alternate embodiment invertible handbag with a closed and open U-mouth, respectively.
Figure 9:
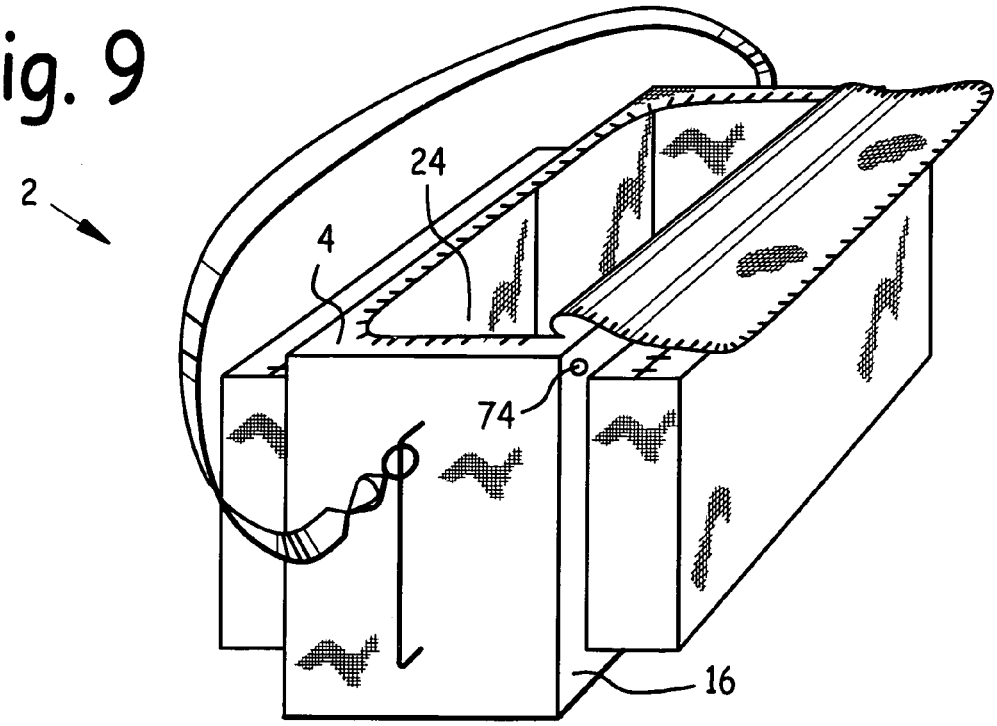

FIGS. 8 and 9 are front quarter elevated isometric views of an alternate embodiment invertible handbag 2 with a closed and open U-mouth 90, respectively. A U-mouth 90 replaces handbag roof mouth 6, and another U-mouth 90 replaces handbag floor mouth 12. Like handbag roof mouth 6 and handbag floor mouth 12, U-mouths 90 serve to provide access to handbag compartment 24.

An advantage to replacing handbag roof mouth 6 with a U-mouth 90, and handbag floor mouth 12 with a U-mouth 90, is easier access to handbag compartment 24. As may be observed in FIG. 9, when U-mouth 90 is open, ample access is afforded to handbag compartment 24.

The method of use of handbag 2 incorporating U-mouth 90 is the same as explained previously in connection with a handbag 2 having a handbag roof mouth 6 and a handbag floor mouth 12: when opening or closing handbag roof mouth 6 is instructed, the U-mouth 90 in handbag roof 4 should be opened or closed; when opening or closing handbag floor mouth 12 is instructed, the U-mouth 90 in handbag floor 10 should be opened or closed.

U-mouth 90 comprises a U-mouth leg 94 disposed at each end of a U-mouth spine 92 at substantially a 90 degree angle, and each U-mouth leg 94 communicates with U-mouth spine 92. A continuous U-mouth closure 96 is disposed along the entire length of U-mouth 90, as depicted in FIGS. 8 and 9. Opening U-mouth closure 96 frees U-mouth 90 to open, as depicted in FIG. 9.

In the preferred embodiment, U-mouth closure 96 was a zipper having slider 70 with pull tab 72 attached. Pull tab 72 comprised pull tab closure 74. In the preferred embodiment pull tab closure 74 comprised a permanent magnet attached to pull tab 74, and a mating piece of ferromagnetic material or an opposite-poled magnet attached to a corresponding handbag side, handbag first side 16 in FIGS. 8 and 9. In operation, the zipper is closed completely, and then pull tab 72 is folded flat against the adjacent handbag side until its magnet latches onto the piece of ferromagnetic material or opposite-poled magnet attached to the adjacent handbag side, as explained previously in connection with arrow 76 in FIG. 1.

Although the figures depict pull tab closure 74 as a round permanent magnet attached to pull tab 74 and a round piece of ferromagnetic material or opposite-poled magnet attached to the adjacent handbag side, it is intended to fall within the scope of this disclosure that any appropriate pull tab closure 74 be used, including but not limited to a snap, button and buttonhole, hook and loop material, etc.

In the preferred embodiment handbag roof 4; handbag floor 10; handbag sides 16, 18, 20 and 22; sidebag roof 32; sidebag floor 38; sidebag sides 44, 46, 48 and 50; strap 60; pull tab 72; and interior pockets 28 were made of leather, fabric, synthetic, or any other appropriate material. Handbag roof mouth closure 8, handbag floor mouth closure 14, sidebag roof mouth closure 36, sidebag floor mouth closure 42 and U-mouth closure 96 were commercially available zippers, hook and loop material, snaps, buttons, or other appropriate closures. Pull tab closure 74 was magnetic, snaps, button and buttonhole, hook and loop material, or other appropriate closure. Strap bridge 64 and strap ring 61 were made of metal, nylon, synthetic, plastic, or other appropriate material. Strap swivel 62 was a commercially available swivel connector.

While a preferred embodiment of the invention has been illustrated herein, it is to be understood that changes and variations may be made by those skilled in the art without departing from the spirit of the appending claims.

DRAWING ITEM INDEX

| | |
|---|---|
| 2 | invertible handbag |
| 3 | handbag longitudinal axis |
| 4 | handbag roof |
| 6 | handbag roof mouth |
| 8 | handbag roof mouth closure |
| 10 | handbag floor |
| 12 | handbag floor mouth |
| 14 | handbag floor mouth closure |
| 16 | handbag first side |
| 18 | handbag second side |
| 20 | handbag third side |
| 22 | handbag fourth side |
| 24 | handbag compartment |
| 26 | key |
| 28 | interior pocket |
| 29 | elastic |
| 30 | invertible sidebag |
| 32 | sidebag roof |
| 34 | sidebag roof mouth |
| 36 | sidebag roof mouth closure |
| 38 | sidebag floor |
| 40 | sidebag floor mouth |
| 42 | sidebag floor mouth closure |
| 44 | sidebag first side |
| 46 | sidebag second side |
| 48 | sidebag third side |
| 50 | sidebag fourth side |
| 52 | sidebag compartment |
| 60 | strap |
| 61 | strap ring |
| 62 | strap swivel |
| 64 | strap bridge |
| 65 | strap bridge leg |
| 66 | strap bridge span |
| 68 | arrow |
| 70 | slider |
| 72 | pull tab |
| 73 | magnet |
| 74 | pull tab closure |
| 75 | ferromagnetic material |
| 76 | arrow |
| 80 | cell phone |
| 82 | skin cream |
| 84 | lipstick |
| 86 | arrow |
| 90 | U-mouth |
| 92 | U-mouth spine |
| 94 | U-mouth leg |
| 96 | U-mouth closure |

I claim:

1. An invertible handbag comprising a handbag compartment defined by a handbag roof, a handbag floor, a handbag first side, a handbag second side, a handbag third side, and a handbag fourth side; a handbag roof mouth bordered by a handbag roof mouth closure in said handbag roof; a handbag floor mouth bordered by a handbag floor mouth closure in said handbag floor; said handbag roof being disposed along opposite edges of the handbag sides from said handbag floor; said handbag second side and said handbag fourth side being disposed substantially at opposite ends of said roof mouth and said floor mouth; a strap; a strap bridge attached to said handbag second side; and a strap bridge attached to said handbag fourth side; each said strap bridge being disposed substantially in a plane containing said handbag roof mouth closure when closed and said handbag floor mouth closure when closed; one end of said strap being slidably attached to said strap bridge which is attached to said second handbag side; another end of said strap being slidably attached to said strap bridge which is attached to said fourth handbag side; an upper end of each said strap bridge being disposed above a center of gravity of said invertible bag when said strap bridge is substantially vertical, whereby said invertible handbag is prevented from capsizing.

2. The invertible handbag of claim 1 wherein each said strap bridge comprises a strap bridge leg attached at each end of a strap bridge span at substantially right angles, said strap bridge legs and said strap bridge span being substantially co-planar, each said strap bridge leg being attached to a respective said handbag side at substantially a right angle.

3. The invertible bag of claim 1 wherein each end of said strap is slidably attached to a respective strap bridge by means of a strap swivel.

4. The invertible bag of claim 1 wherein each end of said strap is slidably attached to a respective strap bridge by means of a strap ring sized to slidably admit said strap bridge.

5. The invertible bag of claim 1 wherein said handbag roof mouth closure and said handbag floor mouth closure are zippers; and each said zipper comprises a slider, a pull tab attached to said slider, and a pull tab closure; whereby said pull tab may be releasably held closed.

6. The invertible bag of claim 5 wherein said pull tab closure comprises a magnet attached to said pull tab, and mating ferromagnetic material or an opposite-poled magnet attached to a respective said handbag side.

7. The invertible bag of claim 5 wherein said pull tab closure comprises a snap attached to said pull tab, and mating snap attached to a respective said handbag side.

8. The invertible bag of claim 1 further comprising at least one invertible sidebag attached to one said handbag side; each said invertible sidebag comprising a sidebag compartment defined by a sidebag roof, a sidebag floor, a sidebag first side, a sidebag second side, a sidebag third side, and a sidebag fourth side; a sidebag roof mouth bordered by a sidebag roof mouth closure in said sidebag roof; and a sidebag floor mouth bordered by a sidebag floor mouth closure in said sidebag floor; said sidebag roof being disposed along opposite edges of the sidebag sides from said sidebag floor.

9. The invertible bag of claim 8 wherein each said sidebag roof mouth closure and said sidebag floor mouth closure are zippers; and each said zipper comprises a slider, a pull tab attached to said slider, and a pull tab closure; whereby said pull tab may be releasably held closed.

10. A method of use for an invertible bag comprising the steps of:

A. Providing an invertible bag comprising a handbag compartment defined by a handbag roof, handbag floor, a handbag first side, a handbag second side, a handbag third side, and a handbag fourth side; a handbag roof mouth bordered by a handbag roof mouth closure in said handbag roof; a handbag floor mouth bordered by a handbag floor mouth closure in said handbag floor; said handbag second side and said handbag fourth side being disposed substantially at opposite ends of said roof mouth and said floor mouth; a strap; a strap bridge attached to said handbag second side; a strap bridge attached to said handbag fourth side; each said strap bridge being disposed substantially in a plane containing said handbag roof mouth closure when closed and said handbag floor mouth closure when closed; one end of said strap being slidably attached to said strap bridge which is attached to said second handbag side; another end of said strap being slidably attached to said strap bridge which is attached to said fourth handbag side; an upper end of each said strap bridge being disposed above a center of gravity of said invertible bag when said strap bridge is substantially vertical, whereby said invertible handbag is prevented from capsizing; items in said handbag compartment; a lost item lower-most in said handbag compartment when said handbag floor faces down; and a handbag longitudinal axis defined as a line parallel to and midway between said handbag roof and said handbag floor and passing through geometrical centers of said handbag second side and handbag fourth side; said handbag roof being disposed along opposite edges of the handbag sides from said handbag floor; said handbag second side and said handbag fourth side being disposed substantially at opposite ends of said roof mouth and said floor mouth;

B. Ensuring that said handbag roof closure and said handbag floor closure are closed;

C. Rotating said invertible handbag substantially 180 degrees about said handbag longitudinal axis;

D. Said strap ends sliding to uppermost ends of said strap bridges;

E. A position of said strap ends on uppermost ends of said strap bridges above a center of gravity of said invertible bag preventing said invertible bag from capsizing;

F. Opening said handbag roof mouth closure;

G. Opening said handbag roof mouth; and

H. Seeing and removing said lost item.

11. The method of use for an invertible bag of claim 10 comprising the further steps of:

I. Providing that said handbag roof mouth closure and said handbag floor mouth closure are zippers;

J. Providing that each said zipper comprises a slide, a pull tab attached to said slide, and a pull tab closure;

K. Engaging the handbag roof mouth closure pull tab closure when said handbag roof mouth closure is closed;

L. Dis-engaging said handbag roof mouth closure pull tab closure when opening said handbag roof mouth closure;

M. Engaging the handbag floor mouth closure pull tab closure when said handbag floor mouth closure is closed; and N. Dis-engaging said handbag floor mouth closure pull tab closure when opening said handbag floor mouth closure.

12. An invertible handbag comprising a handbag compartment defined by a handbag roof, a handbag floor, a handbag first side, a handbag second side, a handbag third side, and a handbag fourth side; a handbag roof mouth bordered by a handbag roof mouth closure in said handbag roof; a handbag floor mouth bordered by a handbag floor mouth closure in said handbag floor; a strap; a strap bridge attached to said handbag second side; and a strap bridge attached to said handbag fourth side; said handbag roof being disposed along opposite edges of the handbag sides from said handbag floor; said handbag second side and said handbag fourth side being disposed substantially at opposite ends of said roof mouth and said floor mouth; each said strap bridge being disposed substantially in a plane containing said handbag roof mouth closure when closed and said handbag floor mouth closure when closed; one end of said strap being slidably attached to said strap bridge which is attached to said second handbag side; another end of said strap being slidably attached to said strap bridge which is attached to said fourth handbag side; an upper end of each said strap bridge being disposed above a center of gravity of said invertible bag when said strap bridge is substantially vertical, whereby said invertible handbag is prevented from capsizing.

13. The invertible bag of claim 12 further comprising an invertible sidebag attached to said handbag first side; and an invertible sidebag attached to said handbag third side; each said invertible sidebag comprising a sidebag compartment defined by a sidebag roof, sidebag floor, a sidebag first side, a sidebag second side, a sidebag third side, and a sidebag fourth side; a sidebag roof mouth bordered by a sidebag roof mouth closure in said sidebag roof; and a sidebag floor mouth bordered by a sidebag floor mouth closure in said sidebag floor; said sidebag roof being disposed along opposite edges of the sidebag sides from said sidebag floor; said handbag first side being disposed between said handbag second side and said handbag fourth side; said handbag third side being disposed between said handbag second side and said handbag fourth side.

14. The invertible bag of claim 13 wherein said handbag roof mouth closure and said handbag floor mouth closure are zippers; and each said zipper comprises a slider, a pull tab attached to said slider, and a pull tab closure; whereby said pull tab may be releasably held closed.

15. The invertible bag of claim 14 wherein each end of said strap is slidably attached to a respective strap bridge by means of a strap swivel.

16. The invertible bag of claim 15 wherein each said strap bridge comprises a strap bridge leg attached at each end of a strap bridge span at substantially right angles, said strap bridge legs and said strap bridge span being substantially co-planar, each said strap bridge leg being attached to a respective said handbag side at substantially a right angle, each end of said strap being slidably attached to a respective strap bridge by means of a strap ring sized to slidably admit said strap bridge span.

17. The invertible bag of claim 16 wherein said pull tab closure comprises a magnet attached to said pull tab, and mating ferromagnetic material or an opposite-poled magnet attached to a respective said handbag side.

18. The invertible bag of claim 13 wherein each said sidebag roof mouth closure and said sidebag floor mouth closure are zippers; and each said zipper comprises a slider, a pull tab attached to said slider, and a pull tab closure; whereby said pull tab may be releasably held closed.

19. The invertible bag of claim 13 further comprising at least one interior pocket mounted inside said handbag compartment to one of the sides.

20. The invertible bag of claim 1 wherein said handbag roof mouth is a U-mouth, and wherein said handbag floor mouth is a U-mouth, each said U-mouth comprising a U-mouth leg disposed at each end of a U-mouth spine at substantially a ninety degree angle, each said U-mouth leg communicating with a respective said U-mouth spine, said U-mouth being bordered by a U-mouth closure.

21. The invertible bag of claim 20 wherein each said U-mouth closure is a zipper; and each said zipper comprises a slider, a pull tab attached to said slider, and a pull tab closure; whereby said pull tab may be releasably held closed.

22. The invertible bag of claim 21 wherein said pull tab closure comprises a magnet attached to said pull tab, and mating ferromagnetic material or an opposite-poled magnet attached to a respective said handbag side.

23. The invertible bag of claim 21 wherein said pull tab closure comprises a snap attached to said pull tab, and mating snap attached to a respective said handbag side.

24. The invertible bag of claim 17 wherein said handbag roof mouth is a U-mouth, and wherein said handbag floor mouth is a U-mouth, each said U-mouth comprising a U-mouth leg disposed at each end of a U-mouth spine at substantially a ninety degree angle, each said U-mouth leg communicating with said U-mouth spine, a first said U-mouth spine being disposed in said handbag roof adjacent said handbag third side and its associated pull tab closure being disposed on said handbag first side, a second said U-mouth spine being disposed in said handbag floor adjacent said handbag first side and its associated pull tab closure being disposed on said handbag third side.

* * * * *